United States Patent [19]

Green

[11] Patent Number: 4,786,322

[45] Date of Patent: Nov. 22, 1988

[54] MAGNESIUM AND CALCIUM COMPOSITE

[75] Inventor: William G. Green, Freeport, Tex.

[73] Assignee: The Dow Chemical Company, Midland, Mich.

[21] Appl. No.: 98,815

[22] Filed: Sep. 18, 1987

Related U.S. Application Data

[63] Continuation-in-part of Ser. No. 822,459, Jan. 27, 1986, Pat. No. 4,705,561.

[51] Int. Cl.[4] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,492,114 | 1/1970 | Schneider | 75/53 |
| 3,801,303 | 4/1974 | Kotler | 75/58 |
| 3,885,956 | 5/1975 | Obst | 75/53 |
| 3,957,502 | 5/1976 | Cull | 75/58 |
| 3,998,625 | 12/1976 | Koros | 75/53 |
| 4,040,818 | 8/1977 | Clegg | 75/58 |
| 4,137,072 | 1/1979 | Kawakami | 75/58 |
| 4,139,369 | 2/1979 | Kandler | 75/58 |
| 4,209,325 | 6/1980 | Cooper | 75/58 |

*Primary Examiner*—Peter D. Rosenberg

*Attorney, Agent, or Firm*—Gunn, Lee & Jackson

[57] ABSTRACT

A product and method of manufacture are set forth. The product is used in desulfurizing steel. Magnesium is in its molten state, and with vigorous stirring, a reactant, such as $CaC_2$ is added. A relatively brittle material is obtained upon cooling which can be ground to a particulate form and used in steel desulfurization. The composite is both a mixture of magnesium and reactant, such as $CaC_2$, and also includes $Mg_2Ca$ alloy.

17 Claims, No Drawings

MAGNESIUM AND CALCIUM COMPOSITE

BACKGROUND OF THE DISCLOSURE

This is a Continuation In Part of Ser. No. 822,459 filed Jan. 27, 1986, now U.S. Pat. No. 4,705,561 assigned to the assignee of the present disclosure.

This disclosure is directed to an injectable composite which is adapted for use for example, in desulfurizing steel manufacturing processes. In addition, nodules in molten ferrous metal are altered in shape to improve workability of such metal products. Generally, it is undesirable to incorporate sulfur in steel. This material provides an additive which is injected into the steel manufacturing process to remove sulfur. This injectable appears to reduce risk of explosion, dust problems, product separation and is effective for sulfur removal. Injectables are added during steel manufacturing through injection lances. Magnesium based injectable materials with salt coatings are known. This coating leads to problems with injection line plugging because of hygroscopic nature of the salt coating material. As the injectable material is introduced into the steel, there is a possibility of violent reaction. For instance, the addition of magnesium in particulate form runs the risk of violent reaction. The violent reaction may take the form of bubbling, splattering, or the like. Moreover, finely ground particulate dust is difficult to meter in blast furnace injection processes. A related factor is that finely ground dust injectables create a hazard in handling. If they are finely ground, exposed to high temperatures and have some supply of oxygen available, there is the possibility of explosion. The injectable can be used in any mixture of molten ferrous material (with low carbon or with high carbon) which is normally molten at temperatures between about 1200° C. and 1800° C.

Another important problem relates to reduction of nodule size. In a molten ferrous metal, graphite forms slivers which may degrade physical characteristics during metal working. The injectable of this disclosure reduces nodule size by changing nodule shape, reducing nodule surface size and forming nodules of spherical shape. Thus, one feature of the injectable is that it operates to nodularize the molten ferrous metal.

Magnesium is well known as an injectable for molten metals. In some cases, magnesium is used as an alloying agent, as a deoxidizer, as a desulfurizer, or in some cases as a nodularizer. Aluminum has also been used as a injectable for molten metals, especially as an aid for calcium compound, e.g. lime (CaO), which is used as a desulfurizing agent for molten iron. Calcium may be used in place of the magnesium, but it is not cost-competitive with magnesium or aluminum.

It is known that magnesium or aluminum powder can be used along with a calcium compound, e.g. CaO, by being injected into molten iron either as a physical mixture with a particulate calcium compound or by staged successive injections of the magnesium or aluminum with the calcium compound.

The injectable of this disclosure is one that can be added to a steel manufacturing process with reduced risk of explosion, reduced dust problems, reduced segregation of magnesium and lime, and yet obtain a high degree of sulfur removal. One reference of interest is U.S. Pat. No. 4,139,369. This is a powder mixture of magnesium and selected calcium compounds. U.S. Pat. No. 4,139,369 discloses a mixture of magnesium powder with CaO, $CaCO_3$, $CaC_2$, or $CaMg(CO_3)_2$ powder, wherein the calcium compound has a particle size of 0.06 to 3 mm and the magnesium particles have a size of 0.060 to 0.095 mm. No particular method of preparation is set forth. U.S. Pat. No. 4,182,626 discloses a staged mixing process for combining pulverulent magnesium metal with fine particle alkaline earth metal compounds. This patent mentions a method of manufacture in multiple stages to reduce ignition of the magnesium in powder form. Perhaps a more remote reference is U.S. Pat. No. 4,209,325 which is directed to a mixture of alkaline earth metal with sintered CaO which contains at least one fluxing agent, said fluxing agent being e.g. alumina, alkali metal fluoride, alkaline earth metal fluoride, or sodium carbonate. Preferred fluxing agents are alumina or selected fluorides. A mixture of magnesium and calcium oxide is set forth in U.S. Pat. No. 4,137,072. This patent appears to be directed to a molded pellet form of a mixture of at least one metal selected from MgO, CaO and $Al_2O_3$. Preference for Mg+MgO is shown. The use of an organic polymer binding material as an optional ingredient in the mixture is disclosed. U.S. Pat. No. 4,173,466 discloses compacted tablets of particulate magnesium, calcium and iron in which the iron is the predominant ingredient. U.S. Pat. No. 4,586,955 discloses the use of aluminum metal powder with CaO to desulfurize hot metal in a ladle. U.S. Pat. Nos. 4,559,084 and 4,421,551 disclose salt-coated magnesium granules for use in desulfurizing molten iron. Despite the general success in using magnesium or aluminum particles mixed with such things as CaO and $CaC_2$ powder as an injectable in molten metals, e.g. molten iron, there remains a need in the industry for an injectable which does not create excessive, unwanted splashing of the molten metal as the injectable is undergoing reaction therein, which is uniform in composition, which is more easily and safely handled, and which is non-segregating during shipping, storage, and handling. The injectables of the present invention include composites of molten magnesium or aluminum, or alloys thereof (i.e. "metal reagents") and an inorganic, alkaline earth metal compound such as CaO, $CaC_2$, MgO, on symbols, these $CaAl_2O_4$, dolime or mixtures of these, or e.g., $Al_2O_3$, and the like. "Dolime" is well known as being calcined dolomite, and comprises approximately equal amounts of MgO and CaO. $CaC_2$ successfully, in conjunction with Mg, yields a material which seems to be both a composite and alloy just as obtained from CaO. It is different in that it adds carbon to the product some of which stays in the injectable and in turn finds its way into the steel after injection and most of which comes out of the reactor as a black fume believed to be carbon black. The small quantities necessary to reduce sulfur do not seem to add carbon in such quantity as to change the overall nature of the steel. yet the reaction product of the molten Mg and $CaC_2$ still provides an injectable suitable for sulfur reduction in the making of steel and also aids in the denodularization so helpful in nodular iron manufacture. The composite of the present disclosure is both a mixture and an alloy. The composite is therefore somewhat brittle and easily ground to powder form without the dust problems of the prior art. Even when in powdered form, the particles are harder to ignite than Mg powder and therefore more easily stored and handled. At the time of injection, there is a less violent reaction in the molten process steel. Moreover, the composite of this injection is a highly desirable injection agent free substantially of the problems of hygroscopic water adsorption, potential dust explosions, and the like. Moreover, the injectable lends itself readily to desulfurization of ferrous metals. By contrast, pure magnesium is difficult to grind while this product is easily broken to pieces and processed to size.

For the purposes of conciseness and ease of description the following terminology is used:

1. The term "metal reagent" herein refers to a Magnesium or Aluminum metal, or alloys of these metals, employed in the "injectable composite";

2. The term "particulate inorganic reagent" herein refers to particulate inorganic alkaline earth metal compound(s) and/or aluminum compound(s);

3. The term "injectable" refers to a "particulate composite" which is particularly useful as an injectable for molten metal. The injectable is actually a composite of the metal reagent and the inorganic reagent;

4. The term "process metal" is the metal into which the injectable composite is injectable.

SUMMARY OF THE INVENTION

Briefly, the process contemplates utilizing magnesium in a molten state, stirring vigorously while introducing a calcium compound or aluminum compound into the melt, all accomplished under an inert gas layer to thereby form the composite mixture. On cooling, it can be broken and then ground yielding both a mixture of magnesium with calcium oxide and/or aluminum oxide and also magnesium and calcium in an alloy. In addition, $CaC_2$ yields a particularly desirable injectable.

More particularly, the present invention resides in a particulate injectable for use in the desulfurization of molten ferrous metals, comprising a minor proportion of a particulate inorganic calcium or aluminum reagent and a major (more than 50% by weight) proportion of a Mg metal reagent.

DETAILED DESCRIPTIONS INCLUDING THE PREFERRED EMBODIMENTS

In a generalized embodiment a composite of magnesium and lime is formed in the following manner. A suitable quantity of magnesium is heated in a suitable vessel, e.g., a ladle. If available, molten magnesium can be taken directly from a Mg producing process such as an electrolytic cell or an alloying process. It can be heated to a molten state at about 651° C. or more. There is a risk of fire on exposure of molten Mg to oxygen in the atmosphere. Accordingly, a layer of substantially inert gas is kept over the molten Mg to reduce the chance of fire. Suitable gases include, e.g., a mixture of $CO_2$ and $SF_6$. This inert gas suppresses the risk of fire by substantially excluding oxygen and nitrogen from contacting the molten Mg. Pure magnesium melts at about 651° C. and most magnesium alloys melt somewhat lower than that. The temperature range is from a low of 651° C. to a recommended high of about 850° C. above which temperature the vaporization rate may become intolerable and not be economical. While the vessel contents can be heated to higher temperatures, the desirable alloying occurs at 651° C. and higher. The magnesium in a molten form (heated to some temperature) is gas protected. In a separate container, an approximately equal charge by weight of lime is heated. The lime is not heated to the molten state (it melts and sublimes at 2,580° C.) but such heating is not needed. Preheating typically carries the lime up to about 700° C. Again, the lime can be preheated to a wide range of temperatures. Alternatively, the lime can be added at room temperature if added slow enough to avoid chilling the molten Mg too much. It would appear that dispersion of the lime into the molten magnesium is more readily accomplished with a measure of preheating. This is not to say that preheating is absolutely essential, but it is desirable. Preferably, of course, substantially all water is removed from the lime before addition to the molten magnesium.

Lime in finely ground form has air in it when handled in bulk. This reduces the density compared to bulk CaO. Finely divided lime floats due to the surface tension of molten magnesium, a factor making it difficult to introduce the lime beneath the surface of the molten magnesium. Large dense particles are not preferred because they may retard the reaction. The lime is thus ground to powder and introduced to the molten magnesium with vigorous stirring. The stirring typically must be sufficient to sustain a vortex in the ladle or vessel to be able to draw the lime under the surface. In one instance, a mixing blade extending into the melt was used. The tip of the mixing blade was rotated to obtain a velocity of about 10,500 inches per second (about 250 meters/sec) tip speed to create the vortex. It will be understood that other kinds of agitation devices can be used. In general terms, the goal is to introduce the particulate lime in a fashion where it is drawn beneath the surface to thereby enable dispersing within the magnesium. The molten metal surface tension must be overcome. In general terms, the heating continues until all of the lime has been introduced into the ladle and has been stirred underneath the surface of the molten metal.

In considering the ratio of lime to magnesium, it has been discovered as little as 350 ppm of lime does reduce combustion of the composite. Brittleness, however, is caused by increasing the quantity of lime. When the lime reaches about 0.1 to about 0.3% by weight, brittleness begins to increase. In making injectables, brittleness is desirable for easier grinding and handling. thus, the lime added to the magnesium can range anywhere from 0.01%, even as high as 55% or more. The preferred range of lime is between 45 and 50% by weight of the composite when making injectables. A lime content of 0.01% to 0.1%, especially about 0.03% to about 0.05% is useful in making magnesium castings.

The magnesium need not be pure magnesium. Magnesium is also available as an alloy. Two acceptable alloys are AZ91B and AZ91C. While it is substantially magnesium, the AZ91B includes between about 8.3 and about 9.7% by weight aluminum, between about 0.35 to about 1.0% zinc, at least a minimum of manganese exceeding 0.013% and beryllium in trace quantities. Typically, the beryllium is in the range of about 4 to 10 ppm. By contrast, AZ91C is similar, but excludes the beryllium. Suffice it to say, the magnesium stock can be very pure or an alloy commercially available. If an alloy is used, the trace elements generally do not prevent proper alloying with the CaO.

In general terms, increasing the lime above the level of about 350 ppm not only reduces combustibility of the composite but also increases the brittleness. If the lime is increased to about 50% and the magnesium (pure or from an alloy) is the remaining 50% of the ingredients, the resulting product is quite brittle. It is a composite. On suitable laboratory analysis, it yields a composite which is sufficiently brittle that it is able to be easily broken and ground to a particulate form. The size of the particles can be controlled by the degree of grinding. Typically, the particles should be in the range of 8 to 100 mesh, preferably about 30 to 60 mesh, U.S. Standard Mesh, i.e., from 2.38 mm to 0.149 mm. Alternatively, it can be ground in a conventional grinding mill to obtain a specified surface area of square meters per gram. If there are relatively large pieces in the ground product, they are not viewed with alarm because they are still consumed in the desulfurization process. Large particles may require a longer time for ultimate consumption.

The preferred process involves stirring in the vessel and then pouring into a mold of any suitable shape. The mold is preheated for drying. The molten mass is primarily magnesium having the stirred lime in it. It may be heated (before pouring) to any temperature sufficient to maintain a molten state. On pouring, stirring stops and rapid cooling carries the poured material toward solidification. As the thoroughly stirred mass cools, there is an alloy precipitation process. As reported in *Constitution of Binary Alloys,* Hansen, Second-Edition, 1958, McGraw-Hill, the precipitant is $Mg_2Ca$ which precipitates in the molten mass. Remaining materials form a composite or mixture and thereby account for the furnished ingredients. This composite (including the portion which did not alloy) will also solidify to enable grinding of the entire mass.

In general terms, the product after heating and solidification is a composite of magnesium and lime with the precipitant $Mg_2Ca$ alloy. The $Mg_2Ca$ appears to consume a significant portion of added lime. It would appear that the compounding process involves a reaction with the lime, but does not necessarily go to completion, meaning consumption of all the lime. Depending on the degree of stirring, temperature of the mixture, and other factors, the reaction consumes up to about 45% of the calcium (by weight) in the $Mg_2Ca$ alloy. Remaining metallic feed is a composite as will be described. All of the melted material cools to solidify and is available for grinding.

Consider one example of the manufacture of this composite taught by this disclosure. In a ladle beneath a suitable inert gas atmosphere, approximately 10 kilograms of magnesium was heated to a molten state and was obtained. The average temperature in the ladle was in the range of about 690° C. An approximate equal weight of lime was heated in a separate vessel to about 700° C. Through the use of a stirring device, stirring was vigorously undertaken with the tip speeds mentioned above to form a vortex in the molten magnesium. Approximately 10 kilograms of lime was then introduced over a period of about five minutes. Care was taken to be sure that the freshly introduced lime was folded under the surface of the molten magnesium. After the addition, mixing was continued for up to about 30 minutes. The temperature was checked to be sure it was under 715° C. The mixing was then terminated, the contents of the ladle were then poured into a mold and cooled to a hardened state. When cool, the contents were broken out to yield a brittle material. This composite material was then ground. Suitable testing by various analytical techniques showed that about 45% of the lime was alloyed to form $Mg_2Ca$. The alloy was mixed with lime and magnesium in the cooled material. This yielded a particulate product suitable for steel manufacturing, namely the reduction of sulfur in ferrous metal processing.

A reversible reaction which occurs from the addition of lime to magnesium involves the following chemical reaction:

$$Mg + CaO \rightleftharpoons MgO + Ca$$

This reaction is a reversible equation. Indeed, there is a preference to proceed to the left so that the original feed materials are obtained. This reversible situation makes if difficult to obtain any alloy. The alloy $Mg_2Ca$ is obtained as a precipitant as the molten material is cooled. Thus, the lime is added to the molten magnesium at temperatures sufficient to submerge the lime below the surface. Within the molten mass, the constituents undergo the reversible reaction written above. It appears that when the present reaction is done at a temperature between about the melting point of the magnesium metal (or Magnesium alloy) and about 715° C. the $Mg_2Ca$ forms a solution and the reaction reaches equilibrium when about 5% of the CaO has been converted to $Mg_2Ca$. As the temperature of the material is cooled towards 715° C., the precipitant is formed, namely solidifying to remove the alloy $Mg_2Ca$ from further reaction. Because it is removed, this reduces substantially the available constituent material in the vessel. This precipitation breaks the reversible reaction when a significant portion of the material is removed. The alloy $Mg_2Ca$ is about 45 weight percent calcium. Even if all of the materials in the vessel are not converted to this desirable alloy, those which remain are still useful. That is, they can be used in the desulfurization process. Moreover, those materials which are in the mold upon cooling, whether or not $Mg_2Ca$, can be easily ground and provide the same benefits in desulfurization. For that reason, total conversion of the feed to $Mg_2Ca$ alloy is not essential; it is desirable therefore to cool the material so that a substantial portion of the materials is converted into this desirable alloy. This conversion of calcium into the desirable alloy suggests a preferred ratio of 45 weight percent calcium, and provision of up to about 50% lime in the feed is certainly acceptable. Recall that the feed is lime, not pure calcium; the preferred range of lime is about 45 to about 60% by weight of the ingredients furnished for manufacture of the desirable injectable material obtained by the present process. For magnesium castings, however, CaO content of less than 0.1% should be used.

The temperature of the mixed composite material during manufacture changes the relative ratio somewhat. The typical range extends from a low temperature of 651° C. necessary to melt magnesium up to about 850° C., a maximum economically determined to avoid waste of heat energy. There is a mid point at about 715° C., or perhaps a mid range of 705° C. to 725° C. There is another important temperature derived from the reference text, namely 715° C. at which $Mg_2Ca$ alloy precipitates in solution.

In general, heating the mix to a temperature in the range above the magnesium melting temperature of 651° C. and up to the mid range yields a mixture having more calcium, more magnesium oxide, less magnesium and less calcium oxide. The mixture, having more calcium, is very desirable as a desulfurizing agent. The mixture has reduced nodularizing impact compared with the mixture heated to the following temperature range.

A second range extends from the mid range to the maximum. The mixture in this range has increased nodularizing impact. The higher temperature range yields a mixture having relatively more magnesium, less calcium and more calcium oxide.

Even though the two described temperature ranges change the mixture somewhat, it cannot be said that the mixture made at either temperature range is devoid of efficacy when used for the less favored need. That is, the mixture made by the low range of temperature heating still has significant potency for nodularizing molten ferrous metals.

Heating a mixture to the mid range of about 705° C. to 725° C. yields a product having both significant desulfurizing and nodularizing activity. Recalling that $Mg_2Ca$ forms a precipitant at 715° C., this binds available magnesium and calcium. If the temperature is over 715° C., the alloy process still occurs but the alloying is not accompanied by precipitation. Rather, the alloy will be made, remaining in the mixture even though in suspension. At temperatures below 715° C., the alloying process proceeds, removing available magnesium and calcium to form alloy and thereby reduce available element supply. In other words, alloying to form $Mg_2Ca$ occurs at temperatures over a range; however, if the mixture is heated above 715° C. and then cooled, a precipitant is formed in the vessel. This alloy being mixed with the other elements or oxides to define an injectable for use with molten ferrous metals.

In general terms, the two ingredients can be supplied at any ratio of up to about 60% lime. The $Mg_2Ca$ alloy removes a fixed ratio of magnesium and calcium; the total amount of magnesium and calcium being dependent on the intimacy of mixture, temperature and factors relating to the mixing in the vessel as the alloy is formed. As stated earlier, the two feed materials can be varied at any ratio, but 60% lime is a practical upper limit.

In general terms, the product obtained by this method of manufacture does not particularly absorb substantial quantities of water. It can then be injected after grinding to the particulate form, the injection typically involving injection through an injection tube or lance into a vessel during steel manufacture. The mode of injection varies widely.

The lime is not required to be totally pure. However, relatively pure lime is available at reasonable cost, the purity typically being in excess of about 98%. The magnesium used in the present process is optionally pure magnesium although many magnesium alloys can be used. Those alloys which are most desirable are the ones which incorporate traces of aluminum, manganese, and perhaps other typical alloying agents.

Alternate materials (dolime (mgO/CaO), Ca $Al_2O_4$, and $Al_2O_3$) to lime are $CaC_2$. These very acceptable calcium and aluminum materials have been mixed with molten Mg to obtain an injectable of significant use for sulfur reduction. One virtue of $CaC_2$ is that it does not require preheating to drive off moisture, but it should not be allowed to come into contact with moisture. Rather than an inert gas blanket, air with about 80% $N_2$ is acceptable when using $CaC_2$. As suggested by the example below, this seems to be useful to process simplification. One example of using calcium carbide to make the $Mg_2Ca$ composite illustrates casting in an unprotected, but substantially dry, atmosphere at about 700° C. In this procedure, approximately five pounds of calcium carbide was preheated to about 600° C. In a separate container such as a ladle, about 40 pounds of Mg was heated to a molten state. The molten Mg was protected under an oxygen excluding atmosphere. The molten state for the Mg was obtained by heating to temperatures exemplified in the examples above. In any event, after heating of the Mg, the heated calcium carbide was stirred vigorously into the ladle containing the magnesium. The mixing formed a vortex using a stirring apparatus which was operated at approximately same speed as identified in the examples above. After sufficient mixing, a homogeneous cast material in ingot form was formed. This casting occurred without burning. Analysis of the cooled product showed $Mg_2Ca$ alloy in the product. Again, the completed product was not just $Mg_2Ca$; rather, it appeared to be alloyed in regions of the cast product. As before, the cast product was more easily crushed or broken so that it could be formed into small granules for ease of injection.

The foregoing process was again repeated in precisely the same manner except the calcium carbide was preheated to only 200° C. rather than 600° C. Again, very satisfactory results were obtained in a casting process wherein no protective atmosphere was required. As before, no fire was formed and it was concluded that the protective atmosphere was not needed. Again, even at the reduced preheat temperature, the calcium was observed in alloy form throughout the cooled ingot. Also, this ingot again yielded a more brittle material which broke more readily for ease of breaking and grinding whereby an injectable could be obtained. For these reasons, it is believed that this process might be somewhat cheaper to implement in view of the omission of the protective atmosphere.

Preheating of the calcium carbide is best carried out on dry material. If there is excessive moisture, there is a chance of forming acetylene gas. For this reason, it is ideally heated when only in the dry state.

While the foregoing is directed to the preferred embodiment, the scope is determined by the claims which follow.

What is claimed is

1. A method of manufacture of an injectable particulate composite for molten ferrous metal comprising the steps of:

(a) obtaining a specified weigh of magnesium in a molten state at a temperature above about 715° C.;

(b) adding dolime, $CaAl_2O_4$, $Al_2O_3$ or $CaC_2$ as a reactant to the magnesium accompanied with mixing and continuing until sufficient reactant has been added that a specified ratio between magnesium and reactant has been achieved and mixing has occurred;

(c) cooling the mixture to solidify and form a precipitant alloy; and (d) crushing the cooled precipitant alloy to particulate form for subsequent injection into molten metal.

2. The method of claim 1 wherein the particulate form is in a range of 30 to 60 mesh, U.S. Standard Mesh.

3. The method of claim 1 including the step of preheating in a separate container the reactant to an elevated temperature approximating that of the molten magnesium.

4. The method of claim 1 wherein the magnesium is heated to a molten state at a temperature above about 715° C. with a calcium-containing reactant and then cooled to a temperature to form a precipitant alloy $Mg_2Ca$.

5. The method of claim 1 wherein the temperature is less than about 850° C.

6. The method of claim 4 including the steps of:

(a) mixing the reactant at a temperature above ambient in particulate anhydrous form;

(b) mixing the reactant into a stirred vortex in molten magnesium; and (c) cooling the molten magnesium to a temperature below 715° C. to form $Mg_2Ca$ precipitant and then cooling to solidify.

7. The method of claim 1 wherein:

(a) the magnesium is an alloy predominantly of magnesium; and (c) the mixing of the reactant is conducted by agitation of the melted magnesium sufficiently vigorous to force the reactant in particulate form into the melted magnesium.

8. A method of preparing a magnesium based material comprising the steps of:

(a) melting in a container a predominantly magnesium alloy at a temperature above about 715° C. sufficient to obtain melting;

(b) distributing particulate calcium carbide through the melted magnesium sufficiently until particulate clacium carbide is dispersed through the melted magnesium and thereby forming $Mg_2Ca$ precipitant; and (c) casting the melted material to a specified shape by cooling.

9. The method of claim 8 including the step of submerging the calcium carbide below the surface of the melted magnesium.

10. The method of claim 8 wherein the magnesium is melted to a molten state and the calcium carbide is preheated.

11. The method of claim 8 wherein the product thereof is a mixture including $Mg_2Ca$ alloy.

12. The method of claim 8 wherein the molten mixture of magnesium and calcium carbide is cooled through a temperature of 715° C. to cool and thereby form a $Mg_2Ca$ precipitant.

13. A composition of matter suitable for injecting into molten ferrous metal, the composition of matter consisting essentially of magnesium and calcium carbide mixture in particulate form and including $Mg_2Ca$ as a precipitant.

14. The composition of claim 13 wherein the $Mg_2Ca$ incorporates approximately 45% by weight calcium while remaining calcium is in the form of calcium carbide and calcium in mixture with magnesium.

15. The composition of claim 13 wherein the $Mg_2Ca$ is a solid precipitant broken to form particles.

16. The composition of claim 15 wherein the $Mg_2Ca$ is a precipitant formed by mixing magnesium and calcium carbide and is recovered mixed with magnesium in solid form.

17. The composition of matter of claim 13 wherein the $Mg_2Ca$ is an alloy.

* * * * *

UNITED STATES PATENT AND TRADEMARK OFFICE

CERTIFICATE OF CORRECTION

PATENT NO. : 4,786,322

DATED : November 22, 1988

INVENTOR(S) : William G. Green

It is certified that error appears in the above-identified patent and that said Letters Patent is hereby corrected as shown below: Title page:

Under attorney record please add --Walter J. Lee--.

Column 6, line 1, " $Mg + CaO = MgO + Ca$ "

should read -- Mg + CaO === MgO + Ca --.

Column 9, line 20, "clacium" should read --calcium--.

Signed and Sealed this

Twenty-second Day of August, 1989

*Attest:*

*Attesting Officer*

DONALD J. QUIGG

*Commissioner of Patents and Trademarks*